US007334880B2

(12) United States Patent
Nishiwaki et al.

(10) Patent No.: US 7,334,880 B2
(45) Date of Patent: Feb. 26, 2008

(54) METHOD OF DRIVING A DROPLET JETTING HEAD

(75) Inventors: Chise Nishiwaki, Kunitachi (JP); Kazuo Asano, Hino (JP); Shozo Kikukawa, Akiruno (JP)

(73) Assignee: Konica Minolta Holdings, Inc. (JP)

( * ) Notice: Subject to any disclaimer, the term of this patent is extended or adjusted under 35 U.S.C. 154(b) by 359 days.

(21) Appl. No.: 10/946,474

(22) Filed: Sep. 21, 2004

(65) Prior Publication Data

US 2005/0068353 A1 Mar. 31, 2005

(30) Foreign Application Priority Data

Sep. 25, 2003 (JP) ..... 2003-333748

(51) Int. Cl.
*B41J 2/02* (2006.01)

(52) U.S. Cl. ..... 347/75; 347/74; 347/76; 347/6; 347/44; 347/47

(58) Field of Classification Search ..... 347/74, 347/75

See application file for complete search history.

(56) References Cited

U.S. PATENT DOCUMENTS 4,697,193 A * 9/1987 Howkins ..... 347/9
5,689,291 A * 11/1997 Tence et al. ..... 347/10
6,409,295 B1 * 6/2002 Norigoe ..... 347/11
6,533,378 B2 * 3/2003 Ishikawa ..... 347/10

FOREIGN PATENT DOCUMENTS

| | | |
|---|---|---|
| JP | 02-215537 | 8/1990 |
| JP | 04-290748 | 10/1992 |
| JP | 2693656 | 9/1997 |

OTHER PUBLICATIONS

English Abstract for JP 02-215537.
English Abstract for JP 04-290748.
English Abstract for JP 04-369542 corresponds to JP 2693656.

* cited by examiner

*Primary Examiner*—Lamson Nguyen
*Assistant Examiner*—Brian J. Goldberg
(74) *Attorney, Agent, or Firm*—Cantor Colburn LLP

(57) ABSTRACT

A method of driving a droplet jetting head comprising nozzle orifices to jet droplets, pressure generating chambers each of which can store liquid and communicate with one of the orifices, and pressurizing devices to change the pressures of the pressure generating chambers, comprising the steps of increasing the pressure in the pressure generating chamber by the pressurizing device and protruding liquid in the pressure generating chamber from the nozzle orifice as a droplet, and separating the liquid which protrudes from the nozzle orifice when $\alpha/\beta$ is equal to or less than 1/3 where $\alpha$(μm) is the diameter (in micrometers) of an liquid pillar (protruded from the nozzle orifice) at the front end of the nozzle orifice and $\beta$(μm) is the maximum diameter (in micrometers) of the liquid pillar.

33 Claims, 6 Drawing Sheets

FIG. 2 ( a )
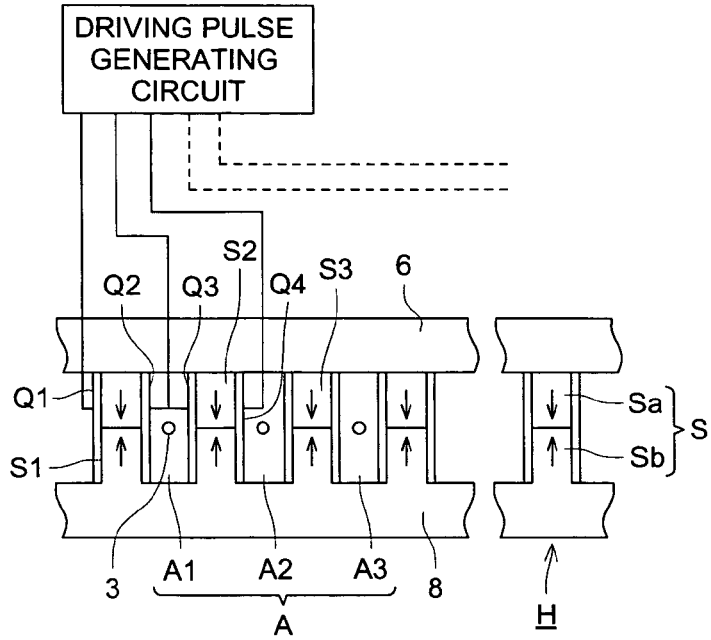
FIG. 2 ( b )
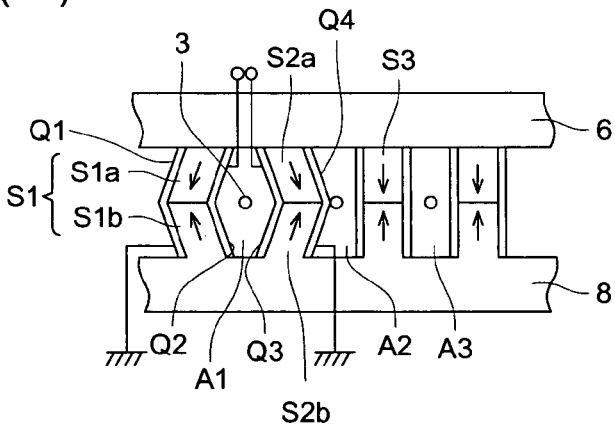
FIG. 2 ( c )
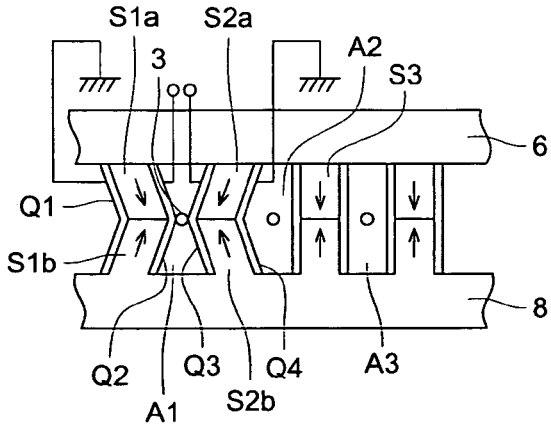

FIG. 3 ( a )
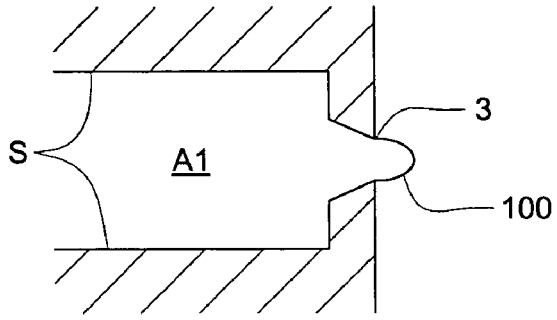
FIG. 3 ( b )
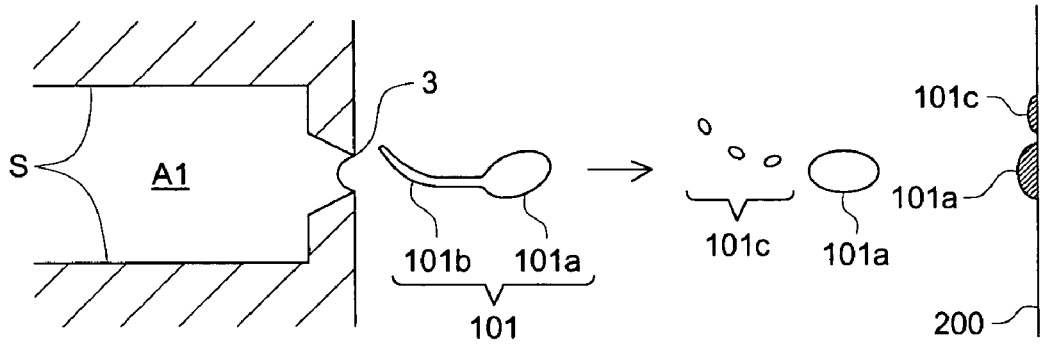
FIG. 4
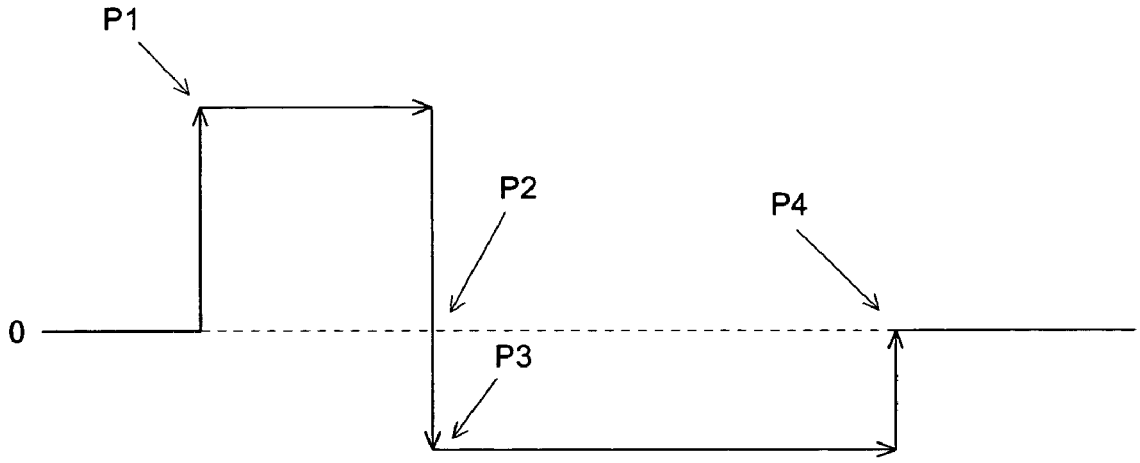

FIG. 5
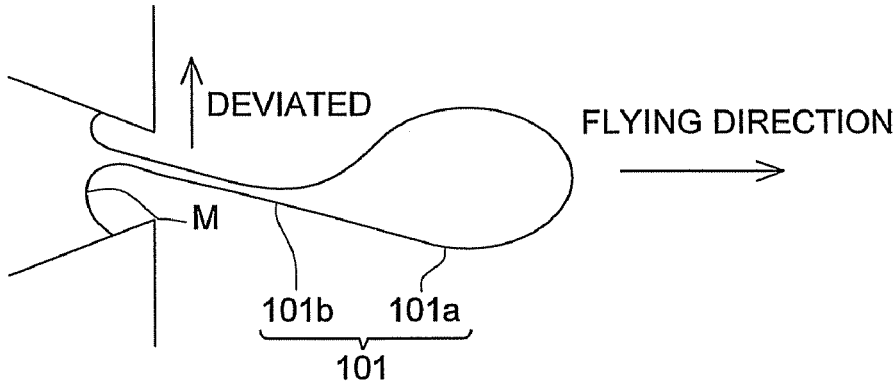
FIG. 6 ( a )
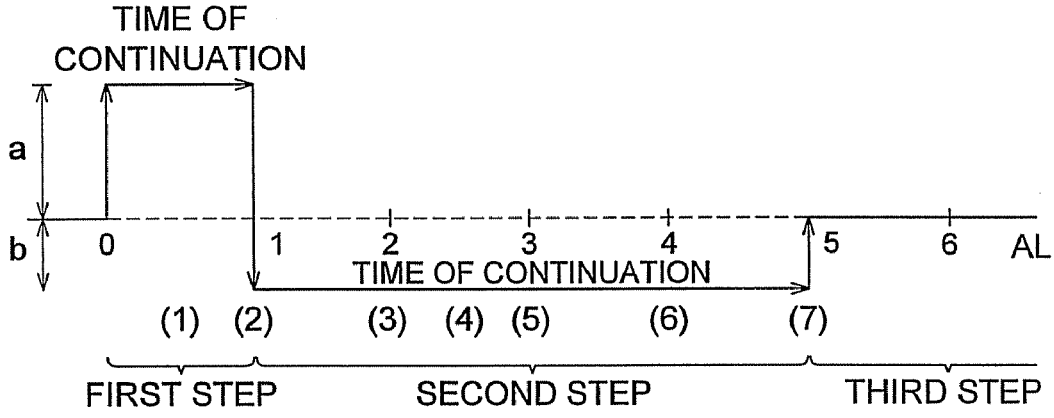
FIG. 6 ( b )
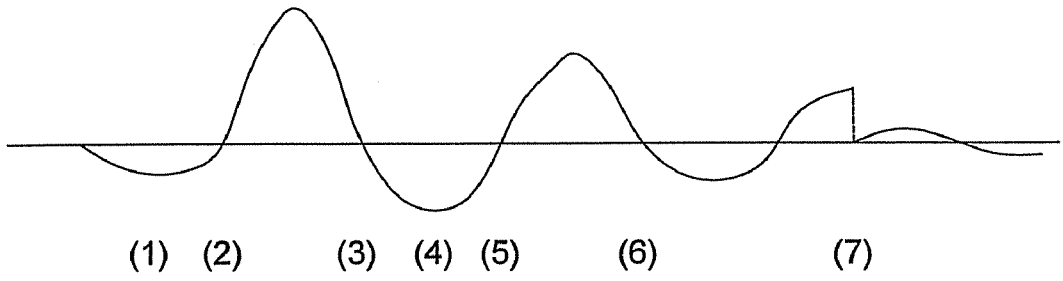

METHOD OF DRIVING A DROPLET JETTING HEAD

BACKGROUND OF THE INVENTION

1. Field of the Invention

This invention relates to a method of driving a droplet jetting head that jets droplets from orifices. More particularly, this invention relates to a method of driving a droplet jetting head that can suppress curvature of the tail of a droplet jetted from a nozzle orifice and improve the accuracy of landing of a droplet.

2. Description of Related Art

A droplet jetting head like an inkjet print head that jets droplets from nozzle orifices to record images with micro ink droplets jets a droplet by generating a pressure in a pressure chamber to land in a recording medium such as recording paper and the like.

There have been various devices to give a pressure to a pressure chamber. The droplet jetting head to be explained here has a pressure chamber surrounded with walls of piezoelectric element and jets an ink droplet through a nozzle orifice by deforming the piezoelectric element. The droplet jetting head is briefly explained below with reference to FIG. 1 to FIG. 4.

FIG. 1 shows a shear mode type ink-jet print head (simply abbreviated as a print head in the description below) which is an embodiment of the droplet jetting head. In details, FIG. 1(*a*) is a perspective view of the print head with a partial sectional view. FIG. 1(*b*) is a sectional view of the print head having an ink feeder. FIG. 2 shows how the print head works. FIG. 3 shows jetting of a droplet. FIG. 4 shows a waveform to drive a print head.

Referring to FIG. 1, the print head consists of an ink tube 1, a nozzle member 2, nozzle orifices 3, a partition wall S, a cover plate 6, ink inlets 7, and a substrate 8. Referring to FIG. 2, an ink chamber is formed by the partition wall S, the cover plate 6, and the substrate 8.

Although FIG. 1(*b*) shows the sectional view of one ink channel A having one nozzle orifice 3, the actual shear mode print head H has a plurality of ink channels A1, A2, . . . , An isolated from each other by partition walls S1, S2, . . . , Sn+1 between the cover plate 6 and the substrate 8. One end of each ink channel (sometimes called a nozzle end) is communicated with a nozzle 3 which is formed on the nozzle member 2. The other end of each ink channel (sometimes called a manifold end) is connected to an ink tank (which is not shown in the figure) via an ink inlet 7 that forms the ink feeder and an ink tube 1. The nozzle 3 forms an ink meniscus.

Each partition wall (S1, S2, . . . ) consists of a partition wall Sa (S1*a*, S2*a*, . . . ) and Sb (S1*b*, S2*b*, . . . ) which have different polarization directions as shown by arrows in FIG. 2. The partition wall S has electrodes Q1 and Q2 in close contact with the wall S1 and the partition wall S2 has electrodes Q3 and Q4 in close contact with the wall S2. Similarly, each partition wall has electrodes in close contact with the wall and the electrodes (Q1, Q2, . . . ) are electrically connected to a driving pulse generating circuit.

In the status of FIG. 2(*a*), electrodes Q1 and Q4, for example, of the print head H are grounded and driving pulses made of square waves of FIG. 4 are applied to electrodes Q2 and Q3. At the first rise (P1) of the driving pulse, an electric field generates perpendicularly to the polarization direction of the piezoelectric material that constitutes the partition walls S1 and S2. This electric field causes a shear deformation on the junction of partition walls S1*a* and S1*b*. Similarly, an opposite shear deformation generates on the junction of partition walls S2*a* and S2*b*. Consequently, the partition walls S1 (S1*a* and S1*b*) and S2 (S2*a* and S2*b*) respectively move outwards and increase the volume of the ink channel A1. This volume expansion generates a negative pressure in the ink channel A1 and causes ink to be sucked into the ink channel A1. At the same time the pressure in the ink channel starts to increase at both the manifold and nozzle ends and the acoustic pressure wave is propagated toward the center of the ink channel. Then the acoustic pressure wave reaches the opposite end and consequently the ink channel has a positive pressure.

When the potential of the pulse is dropped down to 0 (P2) a preset time later after the first driving pulse was applied, the partition walls S1 and S2 return to their neutral positions of FIG. 2(*a*). As the result, a high pressure is applied to the ink in the ink chamber.

Then, a driving pulse (P3) is applied to deform the partition walls S1 (S1*a* and S1*b*) and S2 (S2*a* and S2*b*) in the opposite direction as shown in FIG. 2(*c*) and reduce the volume of the ink channel A1. This generates a positive pressure in the ink channel A1. This positive pressure causes the ink meniscus (part of the ink in the ink channel A1) to change to be pushed out through the nozzle orifice. An ink pillar protrudes from the nozzle orifice. (See FIG. 3(*a*).)

This state is kept for a preset time period and the potential of the pulse is dropped down to 0 (P4). The partition walls S1 and S2 return to their neutral positions from the retracted positions. This increases the volume of the ink channel A1 and draws in the ink meniscus. At the same time, the rear end of the protruded ink pillar is pulled back. As the result, the ink pillar 100 separates from the meniscus and flies as a droplet 101. (See FIG. 3(*b*).)

As explained above, the print head H is characterized by applying positive and negative pressures to the ink in the ink channel by deformation of the partition wall S, wherein the partition wall S constitutes a pressurizing device.

In general, a droplet just jetted from a nozzle orifice consists of a main droplet body 101*a* which is approximately ball-shaped as shown in FIG. 3(*b*) and a tail 101*b* which extends long from the rear end of the main droplet body 101*a*. As the droplet flies, the tail 101*b* breaks into smaller secondary droplets 101*c* called satellite droplets. This ball-shaped main droplet body 101*a* and the secondary droplets 101*c* (satellite droplets) fly together toward a recording medium 200. When they (101*a* and 101*c*) hit the medium 200, an image part is recorded on the medium. When they (101*a* and 101*c*) fly in the same direction, they land in the same point and do not deteriorate the image quality. However, if the secondary droplets 101*c* fly away from the main droplet body 101*a*, they 101*c* land near the touchdown site of the main body droplet as shown in FIG. 3(*b*). This blurs the image part.

The reason why the secondary droplets 101*c* fly away from the main droplet body 101*a* is that the tail 101*b* of a droplet 101 just jetted from a nozzle orifice 3 has a curve that goes away from the flying direction (shown by an arrow in FIG. 3(*b*)) of the main droplet body.

Conventionally, various technologies been disclosed to improve image deterioration due to curves of droplet tails. For example, Patent Documents 1 and 2 disclose technologies by reducing the volume of a pressure chamber to increase the pressure in the pressure chamber, protruding an ink pillar from a nozzle orifice, keeping this state for a preset short time, rapidly removing the deformation of the pressure chamber, and thus shortening the tail of the droplet by this rapid expansion of the pressure chamber. This technology quickens separation of a droplet and makes the short droplet tail fly in the same flying direction of the main droplet body.

Patent Document 3 discloses a technology to prevent the droplet tail from bending by giving the first pulse to protrude an ink pillar from a nozzle orifice, giving the second pulse before the droplet separates from the nozzle orifice to protrude an ink meniscus from the nozzle orifice and separating the droplet at the top of the bulging meniscus.

Patent Document 1: Japanese Non-examined Patent Publication Hei 04-290748

Patent Document 2: Japanese Patent Publication 2693656

Patent Document 3: Japanese Non-examined Patent Publication Hei 02-215537

It has been well known that the curving of a tail of a droplet jetted from a nozzle orifice is caused by unevenness of the inner wall of the nozzle orifice. For example, when the inner wall of the nozzle orifice is slanted unevenly or partially irregular, the surface tension of the ink meniscus inside the nozzle orifice becomes unbalanced as shown in FIG. 5, a force perpendicular to the flying direction of the droplet acts on the droplet tail. This causes the tail to curve just after the droplet detaches from the meniscus M. Therefore, the degree of evenness in the shape of the inner surface of the nozzle orifice greatly has an influence on the stable flight of a droplet without a curve on its tail.

The technologies disclosed by Patent Documents 1 and 2 suppress the influence by the shape of the internal wall of a nozzle orifice by shortening the tail of a droplet jetted from a nozzle orifice and thus quickly separating the droplet from the meniscus. These technologies separate the droplet from the meniscus earlier to shorten the length of the droplet tail and specifically separate a droplet before the meniscus returns to the nozzle orifice. Therefore, it takes a long time for the next droplet to be ready for jetting and a driving frequency may drop. Further, the droplet jetting heads have been used in various fields and forced to use liquids of various properties. Some kinds of liquid cannot be free from having longer droplet tails. As explained above, long droplet tails are easily affected and curved by the forms of inner walls of the nozzles.

To suppress curving of the droplet tail, the inner surface of a nozzle must preferably be a perfect circle in cross section and symmetrical relative to the center of the nozzle orifice. However, it requires a very high working precision when forming a perfect and symmetrical circle in the inner surface of the nozzle and this is very hard. So it is impossible to meet the requirement.

Further, if an unwanted object adheres to the inner surface of the nozzle in use, it is hard to be removed. This object may cause the droplet tail to curve.

So the other ways have been demanded to jet droplets steadily without tail curving instead of making the nozzle inner circles as perfect as possible. As described above, the technology disclosed in Patent Document 3 separates a droplet after protruding a meniscus from the nozzle orifice. This technology can suppress the influence due to the condition of the inner nozzle wall, but uses a second pulse to bulge a liquid meniscus in addition to the first pulse to protrude an ink pillar. So this technology must cancel vibrations caused by this second pulse, but this reduces the driving frequency.

Judging from the above, an object of this invention is to provide a method of driving a droplet jetting head that can steadily jet droplets without droplet tail curves, wherein the tail shapes are not affected by the influence due to the condition of inner nozzle surfaces and the driving frequency is not reduced.

Other objects of this invention will be apparent from the description below.

SUMMARY OF THE INVENTION

The above objects can be accomplished by the following embodiments:

(1) A method of driving a droplet jetting head comprising nozzle orifices to jet droplets, pressure generating chambers each of which can store liquid and communicate with one of the orifices, and a pressurizing device to change the pressures of the pressure generating chambers, comprising the steps of:

increasing the pressure in the pressure generating chamber by the pressurizing device and protruding liquid in the pressure generating chamber from the nozzle orifice, and separating the liquid which is protruded from the nozzle orifice when $\alpha/\beta$ is equal to or less than ⅓ where $\alpha$(μm) is the diameter (in micrometers) of an liquid pillar (protruded from the nozzle orifice) at the front end of the nozzle orifice and $\beta$(μm) is the maximum diameter (in micrometers) of the liquid pillar.

(2) A method of driving a droplet jetting head comprising nozzle orifices to jet droplets, pressure generating chambers each of which can store liquid and communicate with one of the orifices, and a pressurizing device to enlarge or shrink the volume of the pressure generating chambers, comprising the steps of:

a first step of increasing the volume of the pressure generating chamber by the pressurizing device, a second step of decreasing the volume of the pressure generating chamber by the pressurizing device after the first process and protruding liquid in the pressure generating chamber from the nozzle orifice, and a third step of increasing the volume of the pressure generating chamber by the pressurizing device and separating the liquid which is protruded from the nozzle orifice by the second step as a droplet when $\alpha/\beta$ is equal to or less than 1/3 where $\alpha$(μm) is the diameter (in micrometers) of a liquid pillar (protruded from the nozzle orifice) at the front end of the nozzle orifice and $\beta$(μm) is the maximum diameter (in micrometers) of the liquid pillar.

(3) The method of driving a droplet jetting head of (2), wherein the volume of the pressure generating chamber shrunk by the second step is smaller than the volume before the pressure generating chamber is enlarged by the first step and the volume of the pressure generating chamber enlarged by the third step is substantially equal to the volume at the time before the pressure generating chamber enlarged by the first step.

(4) The method of driving a droplet jetting head of (2) or (3), wherein the pressurizing device is so constructed to be driven to change the volume of the pressure generating chamber when a voltage is applied to the device and to make the pressure in the pressure generating chamber different when a different voltage is applied and $|a|$ is greater than $|b|$ where "a" is a voltage applied to the pressure generating chamber in the first step and "b" is a voltage applied to the pressure generating chamber in the third step.

(5) The method of driving a droplet jetting head of (4), wherein the voltages "a" and "b" satisfy the relationship of $|a|/|b|=2$.

(6) The method of driving a droplet jetting head of (4), wherein the voltage ratio $|a|/|b|$ is controlled according to the time period during which the second step lasts.

(7) The method of driving a droplet jetting head of (6), wherein the voltage ratio |a|/|b| is made greater as the time period during which the second step lasts becomes longer.

(8) The method of driving a droplet jetting head of any of (1) to (7), wherein the pressuring device has a piezoelectric element.

(9) The method of driving a droplet jetting head of (8), wherein the piezoelectric element deforms in the Shear mode when an electric field is applied.

(10) The method of driving a droplet jetting head of any of (2) to (9), wherein the time period during which the first step lasts is 0.8 to 1.2 AL (where AL is one half of the acoustic resonant cycle of the pressure generating chamber).

(11) The method of driving a droplet jetting head of any of (2) to (9), wherein the time period during which the first step lasts is 1 AL (where AL is one half of the acoustic resonant cycle of the pressure generating chamber).

(12) The method of driving a droplet jetting head of any of (2) to (11), wherein the time period during which the second step lasts is controlled by the viscosity of the liquid.

(13) The method of driving a droplet jetting head of (12), wherein the time period during which the second step lasts is made longer when the viscosity of the liquid is greater.

(14) The method of driving a droplet jetting head of any of (2) to (11), wherein the time period during which the second step lasts is changed by a transition in head temperature.

(15) The method of driving a droplet jetting head of any of (1) to (14), wherein the viscosity of the liquid is 5 to 15 cp (including both ends).

(16) The method of driving a droplet jetting head of any of (2) to (11), wherein the time period during which the second step lasts is controlled by the surface tension of the liquid.

(17) The method of driving a droplet jetting head of (16), wherein the time period during which the second step lasts is made longer when the liquid has a lower surface tension.

(18) The method of driving a droplet jetting head of any of (1) to (17), wherein the surface tension of the liquid is 20 to 30 dyne/cm (including both ends).

(19) The method of driving a droplet jetting head of any of (1) to (18), wherein the liquid is ink.

(20) The method of driving a droplet jetting head of any of (2) to (19), wherein square waves are applied as the driving waveform to the pressurizing device to change the volume of the pressure generating chamber.

The method of this invention can steadily jet droplets without droplet tail curves, wherein the tail shapes are not affected by the influence due to the condition of inner nozzle surfaces and the driving frequency is not reduced.

BRIEF DESCRIPTION OF THE DRAWINGS

FIG. 1(*a*) shows a perspective view of the print head with a partial sectional view. FIG. 1(*b*) is a sectional view of the print head having an ink feeder.

FIG. 2(*a*), FIG. 2(*b*) and FIG. 2(*c*) show how the print head works.

FIG. 3(*a*) and FIG. 3(*b*) are explanatory figures showing how a droplet is jetted by a conventional method.

FIG. 4 shows a waveform to drive a print head in a conventional driving method.

FIG. 5 shows an ink pillar protruding from a nozzle orifice.

FIG. 6(*a*) shows a driving waveform to accomplish the driving method of this invention and FIG. 6(*b*) shows a transition of pressure applied to ink in an ink channel.

DETAILED DESCRIPTION OF A PREFERRED EMBODIMENT

Below will be explained a preferred embodiment of this invention.

The driving method in accordance with this invention is applicable to any type of droplet jetting head as long as the droplet jetting head consists of some sets of a nozzle orifice to jet droplets, a pressure generating chamber communicating with the orifice, and a pressurizing device to change the pressure of the pressure generating chamber. Further any kind of liquid can be stored in the pressure generating chamber. The description below assumes that the droplet jetting head is an inkjet print head H of the Shear mode type of FIG. 1 and FIG. 2 which is equipped with a pressuring device that varies the pressure by increasing or decreasing the volume of the pressure generating chamber and uses ink as liquid stored in the pressure generating chamber.

Figure 7:
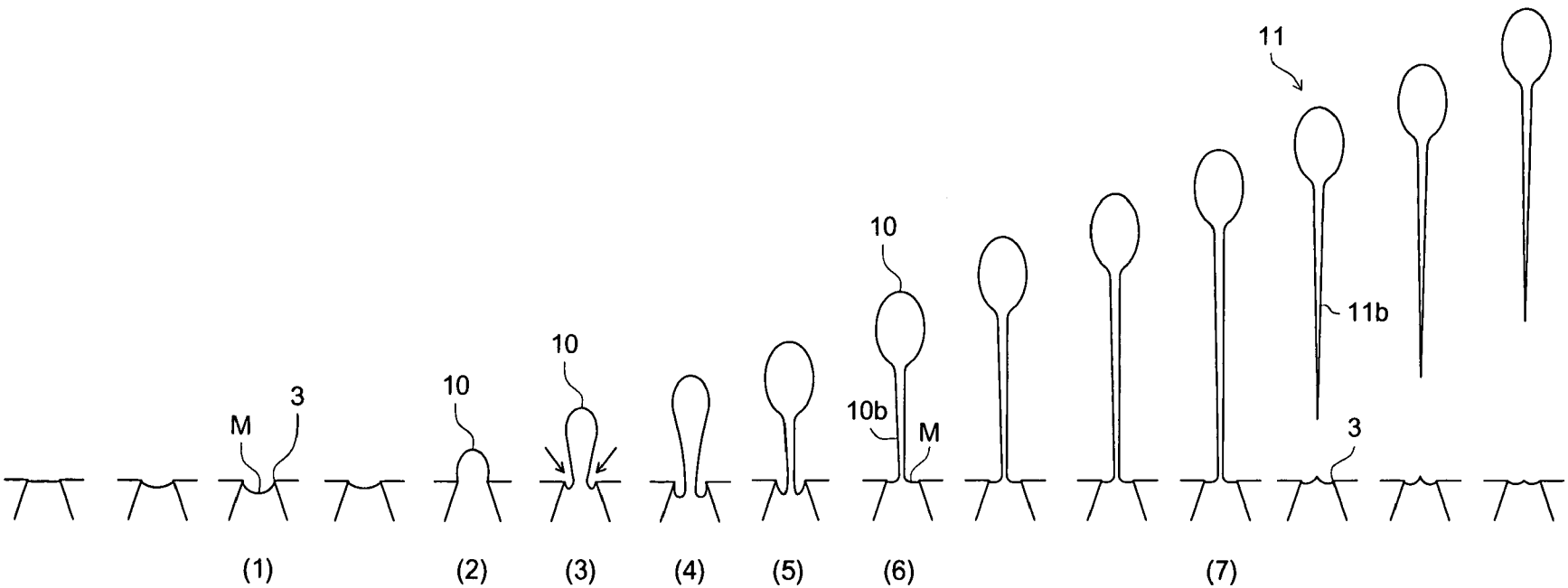
FIG. 7 shows how the ink meniscus and a droplet behave in the driving method of this invention.

FIG. 6(*a*) shows a driving waveform to accomplish the driving method of this invention and FIG. 6(*b*) shows a transition of pressure applied to ink in an ink channel. FIG. 7 shows how the ink meniscus and a droplet behave in the driving method of this invention. The numbers enclosed in parentheses of FIG. 6 and FIG. 7 represent the corresponding time orders of the behaviors.

In this specification, an "ink pillar" means an ink body whose front end is protruding from the orifice of the nozzle 3 but its rear end still clings to the ink meniscus. A "droplet" means an ink body which is completely separated from the ink meniscus in the nozzle 3.

(1) First, the partition wall S is deformed ("draw") as shown in FIG. 2(*b*) from the neutral position to expand the volume of the ink channel A to let ink come into the ink channel (First step). While a driving waveform does not change, the pressure in the ink channel A alternately changes between positive and negative pressures. When this status continues for one AL time period, the drawn meniscus M returns to the front surface on the droplet jetting side of the nozzle 3 (which is called a "recovery position" of the meniscus M) and the ink pressure turns into a positive pressure. When the expanded ink channel A is returned ("release") to the neutral position at this timing, a high pressure is applied to ink in the ink channel A. The ink pressure in the nozzle 3 changes a little later after the driving waveform changes. The change of the meniscus M is delayed further.

Here, "AL" is one half of the acoustic resonant cycle of the ink channel. The time of continuation is defined as a time period between 10% of a rise or fall of a voltage and the start of the next step. The AL value can be obtained by applying a square voltage pulse to the partition wall, measuring the speed of an jetted ink droplet, changing pulse width of the square wave with a constant voltage value of the square wave, and getting a time at which pulse width the ink droplet flies fastest. Here, a square wave means a waveform whose rise or fall time between 10% and 90% of the voltage is within ½ of the AL or preferably within ¼ of the AL.

(2) Next, the volume of the ink channel A is shrunk as shown in FIG. 2(*c*) and a higher pressure is applied to the ink (for reinforcement). With this, an ink pillar protrudes from the orifice of the nozzle 3 (Second step).

(3) After one AL time, the ink pressure turns into a negative pressure. With this, the protruded ink pillar 10 has a constriction at its root as shown in FIG. 7.

(4) After another 0.5 AL time, the negative pressure becomes maximum and the meniscus M retracts deepest oppositely to the orifice of the nozzle 3. With this, the meniscus appears clearly.

(5) After another 0.5 AL time, the ink pressure turns into a positive pressure and the meniscus M moves toward the "recovery position."

(6) A little time later, the meniscus M returns to the "recovery position." The meniscus which is retracted deepest in the nozzle starts to move forward the "recovery position" by the capillary force of the ink and the positive ink pressure. When the meniscus reaches the "recovery position," the ink pillar is not separated from the meniscus. In other words, the tail 10*b* of the ink pillar 10 still clings to the meniscus.

Figure 8:
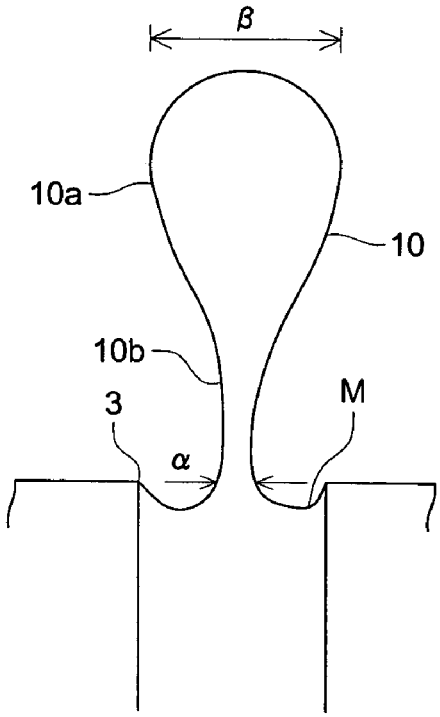
FIG. 8 shows how an ink pillar behaves in the driving method of this invention.
Figure 9:
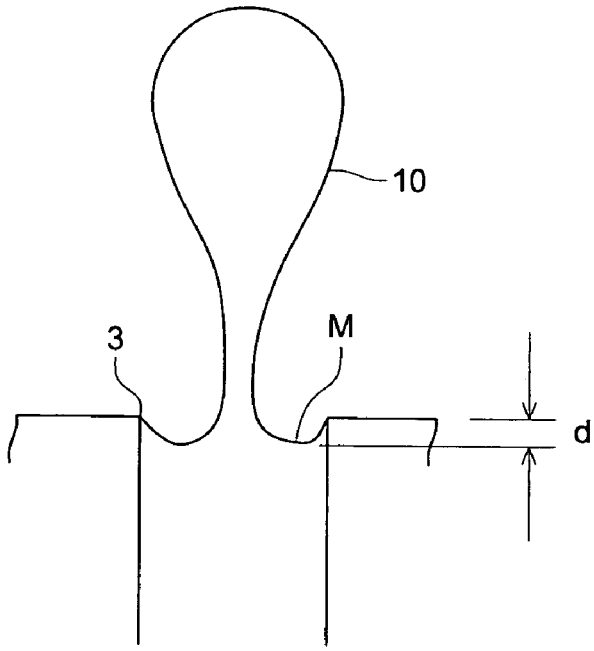
FIG. 9 is an explanatory figure of a positional relationship between a nozzle orifice and a meniscus.

(7) As shown in FIG. 8, the ink pillar 10 jetted from the orifice of the nozzle 3 in the second step consists of a main droplet body 10*a* which is protruded from the nozzle orifice on the front side and its tail 10*b* which trails long from the meniscus M on the rear side. At the second step, a high pressure is applied to the ink to protrude a large ink pillar. When $\alpha/\beta$ is equal to or less than ⅓ where $\alpha$(μm) is the diameter (in micrometers) of an ink pillar at the recovery position of the meniscus M and $\beta$(μm) is the maximum diameter (in micrometers) of the ink pillar 10, the partition walls S are returned to the neutral position as shown in FIG. 2(*a*). The shrunk volume of the ink channel A is expanded. With this, the meniscus M is retracted from the nozzle orifice. The ink pillar 10 protruded from the nozzle orifice (made at the second step) detaches from the meniscus M and flies as a droplet 11 from the nozzle orifice (Third step).

If $\alpha/\beta$ is equal to or less than ⅓ when the ink channel volume is expanded and the meniscus M is retracted, the curve of the droplet tail 10*b* can be suppressed by the retraction of the meniscus M. Namely, when $\alpha/\beta$ is equal to or less than ⅓, the rear end of the tail of the ink pillar clinging to the meniscus M is thin enough. As the thin tail 10 *b* is apt to be curved, the third step makes the tail 10*b* straight by pulling the meniscus and immediately detaches the tail from the meniscus M. With this, the droplet jetting head can jet a droplet 11 with a straight tail 11*b*.

If $\alpha/\beta$ is greater than ⅓, the tail 10*b* of the ink pillar 10 is too thick to be detached immediately when the meniscus M is retracted. In this case, the ink pillar 10 becomes thinner and gets detached as the time passes by. During this time, the surface tension of the meniscus is unbalanced and the joint between the tail 10*b* of the ink pillar 10 and the meniscus M is bent and separated. This curve of the tail cannot be corrected by the retraction of the meniscus and the droplet 11 flies with its tail 11*b* curved.

However, the $\alpha$(μm) value satisfying $\alpha/\beta>1/10$ is preferable as the low limit to effectively suppress curving of a tail 10*b*. If the $\alpha$(μm) value is too smaller, the curving of the tail 10*b* can be corrected at some level but the tail 10*b* is detached before the tail is corrected completely.

It is possible to get the values $\alpha$(μm) and $\beta$(μm) by taking stroboscopic shots of an ink pillar protruding from a nozzle orifice 3 by a CCD camera.

The above method applies a high pressure to the ink at the second step, waits for a time period of 4 AL until the meniscus M substantially returns to the recovery position, returns the partition walls to the neutral position as shown in FIG. 2(*a*). With this, the shrunk ink channel A is expanded to the normal volume.

The time at which the meniscus M substantially returns to the recovery position means a time point at which the meniscus M is approximately at the recovery position or remains protruded from the orifice of the nozzle 3 after the ink pillar 10 is protruded. At this approximate recovery position, the distance "d" between the surface of the meniscus M and the recovery position is ½ or less of the orifice radius and preferably ¼ or less. This approximate recovery position is more preferable than the position at which the meniscus remains protruded because the driving frequency can be increased. By the way, the orifice of the nozzle 3 need not be a perfect circle. It can be elliptic or others. The orifice radius in this invention means ½ of the major axis of the nozzle orifice on the droplet jetting side.

However, it is not fundamental to this invention that the ink pillar 10 is separated from the meniscus M after the meniscus M substantially returns to the recovery position.

The capillary osmotic rate of ink is expressed by {2·(capillary diameter)·(surface tension)·cos(contact angle)}/{8·(viscosity)·(capillary length)}. From this expression, it is known that the capillary osmotic rate of ink is greatly affected by the viscosity and surface tension of the ink. For example, the capillary osmotic rate of ink of 28 dynes/cm (as surface tension) and 10 cp (as viscosity) is 1/10 of the capillary osmotic rate of ink of 40 dynes/cm and 2 cp under a condition of the same capillary diameter and length. Therefore, the viscosity of ink affects the rate at which the meniscus M returns to the recovery position. When the ink is high in viscosity or low in surface tension, the meniscus M returns slower.

Therefore, in general, it takes a lot of time for the meniscus M to return substantially to the recovery position when the ink is high in viscosity or low in surface tension. However, by retracting the meniscus M and separating the droplet 11 when the ratio of pillar diameters $\alpha/\beta$ is equal to or less than ⅓ as stated in this invention, we need not always wait until the meniscus M returns to the recovery position. The droplet jetting head of this invention can jet droplets whose tails 11*b* are straightened by the tail correcting function.

Further, the second step protrudes an ink pillar for a time period of 4 AL by using a DRR (Draw Release Reinforce) type driving waveform (sometimes called a DRR waveform) consisting of a square wave before the third step starts. When the third step returns the partition walls to the neutral position to expand the volume of the ink channel A, the remaining pressure wave in the ink channel A is canceled. Therefore, the remaining pressure never affects the start of the next driving operation. Further when the meniscus M is substantially on the recovery position at this time point, the next driving operation can be started immediately and the diving frequency can be increased. If the "on" time period (to protrude an ink pillar) is 2 AL, the remaining pressure is cancelled fairly before the meniscus M reaches the substantial recovery position (in the deeper position) and later the meniscus M moves to the substantial recovery position by the capillary force only. This extremely delays the returning movement of the meniscus M and consequently reduces the driving frequency.

As explained above, the "on" time period (to protrude an ink pillar) is most preferably 4 AL but preferably 3.5 to 4.4 AL.

In this invention, it is preferable that the volume of the ink channel A shrunk by the second step is smaller than the volume before the ink channel A is expanded by the first step and that the volume of the ink channel A expanded by the third step is substantially equal to the volume before the ink channel A is expanded by the first step. In this way, the driving waveform can be made simple as shown in FIG. 6(*a*). Further, as the partition walls S return to the initial status at the final third step and the remaining pressure wave in the ink channel A is cancelled, the meniscus M is not affected by the remaining pressure after a droplet is jetted. As the result, this can speed up the driving operation.

As shown in FIG. 6(*a*), when |a| is greater than |b| where "a" is a voltage applied to the ink channel A in the first step and "b" is a voltage applied to the ink channel A in the third step, the time becomes shorter before the ratio $\alpha/\beta$ becomes equal to or less than ⅓ and as the result, the third step can start earlier. This is preferable to speed up the driving operation. Further, this quickens the meniscus M to return to the recovery position, which is preferable to fast driving. These voltages "a" and "b" are respectively differential voltages.

It is preferable that the voltages "a" and "b" satisfy the relationship of $|a|/|b|=2$ which enables both fast driving and stable jetting of droplets.

It is also preferable to control the voltage ratio $|a|/|b|$ according to the "on" time of the second step. For example, the remaining pressure wave is attenuated when the "on" time of the second step becomes longer. Therefore, it is possible to cancel the remaining pressure wave effectively by increasing the voltage ratio $|a|/|b|$ when the "on" time of the second step becomes longer. This is particularly preferable.

When the "on" time of the first step is 1 AL as in this embodiment, the negative pressure wave made by the expansion of the pressure generating chamber in the first step turns into a positive pressure at timing of 1 AL. This positive pressure is added to the positive pressure made by shrinkage of the pressure generating chamber in the second step. This sum of positive pressures increases the pressure to jet a droplet most effectively. In this case, the "on" time of the first step is preferably 0.8 to 1.2 AL.

As already explained, differences in ink viscosity and surface tension affect the capillary osmotic rate of ink, that is, the easiness of separation of the meniscus M from the ink pillar 10. When the ink is high in viscosity, the ink pillar 10 is hard to be detached from the meniscus M. Contrarily, when the ink is low in viscosity, the ink pillar 10 is easy to be detached from the meniscus M. Similarly, when the ink is low in surface tension, the ink pillar 10 is hard to be detached from the meniscus M. When the ink is high in surface tension, the ink pillar 10 is easy to be detached from the meniscus M.

In this way, as the easiness of separation of the meniscus M from the ink pillar 10 is dependent upon differences in ink viscosity and surface tension, the time before the ink pillar diameters $\alpha$ and $\beta$ satisfy the above relationship may vary even when the "on" time of the second step is 4 AL.

Therefore, it is preferable to control the "on" time of the second step according to the viscosity of the ink. Specifically the "on" time of the second step is made longer when the ink is high in viscosity or shorter when the ink is low in viscosity. The "on" time of the second step can be changed by setting of the pulse generation circuit of FIG. 2.

Specifically, as the viscosity of an ink is dependent upon the composition of the ink, it is preferable to change the "on" time of the second step as explained above when the ink viscosity changes by the ink composition. The "on" time of the second step can be changed automatically or manually by the operator according to the composition of the ink by changing the setting of the pulse generating circuit. Or it can also be changed by identifying the composition of ink fed to each print head H and changing the setting of the pulse generating circuit for each print head H.

In general, the droplet jetting print head becomes hot by heat due to operation of the pressuring device. This heat also changes (or reduces) the viscosity of the ink. For example, in the print head H of FIG. 1 and FIG. 2, the partition walls S become hot by their shearing deformation and the heat directly affects the ink in the ink channel A. In other words, the viscosity of ink is also dependent upon the temperature of the print head. Therefore, it is preferable to change the "on" time of the second step according to the thermal transition of the print head as explained above.

Figure 1:
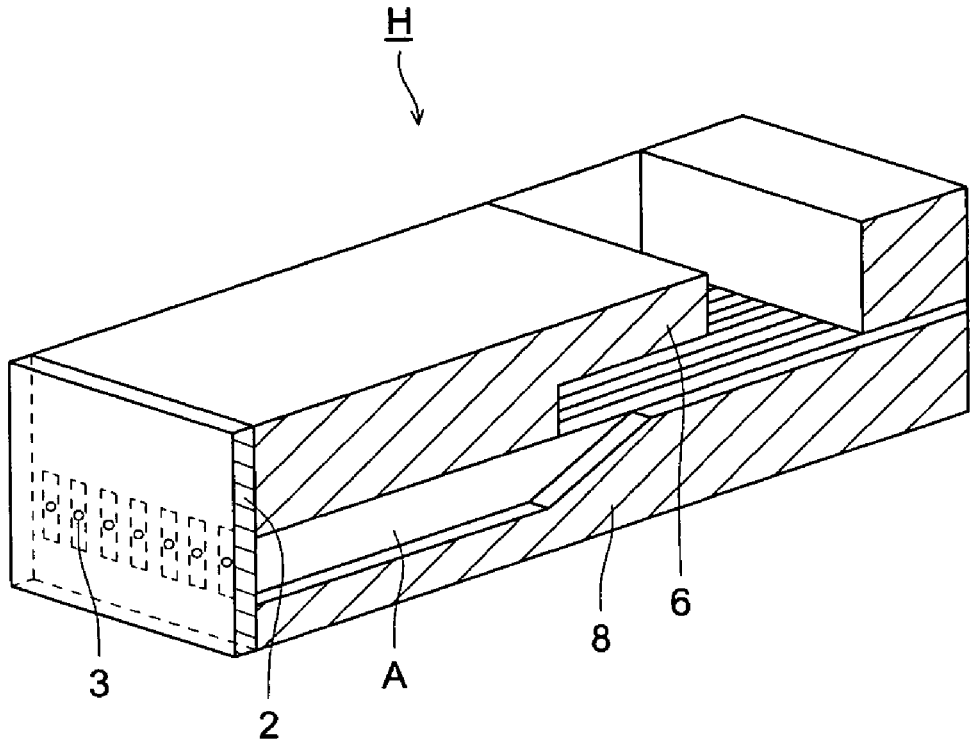
FIG. 1 shows the outlined configuration of an ink jet print head.
Figure 1:
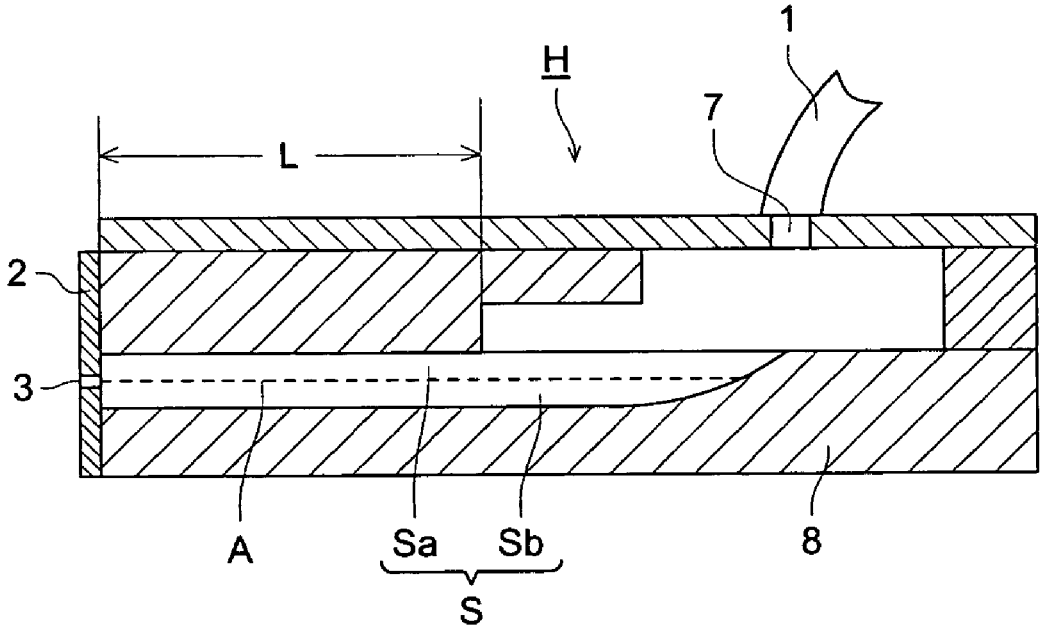

The temperature of the print head can be detected by a thermal sensor (which is not shown in the figure) which is provided, for example, in contact with the cover plate 6 of FIG. 1. The detection signal from the thermal sensor is sent to the pulse generating circuit of the print head H of FIG. 2. The pulse generating circuit uses this signal to change the "on" time of the second step.

Similarly, it is preferable to change the "on" time of the second step according to the surface tension of the ink. Specifically, the "on" time is made longer when the ink is low in surface tension or shorter when the ink is high in surface tension.

As the surface tension of ink is also dependent upon the composition of the ink, it is preferable to change the "on" time of the second step when inks have different compositions.

As the relationship between the ink viscosity or surface tension and the behavior of the meniscus M is specific to a print head and ink, we get the diameter $\alpha$ of an ink pillar 10 at the recovery position of the meniscus M and the maximum diameter $\beta$ by experiment such as microscopic observation of them or simulations such as the finite element method and adjust the signal application timing by an electric circuit device. With this we can apply a driving signal concerning the diameter $\alpha$ of an ink pillar 10 at the recovery position of the meniscus M and the maximum diameter $\beta$. The driving method of this invention is strikingly effective when the ink viscosity is 5 to 15 cp (including both). This is because the ink of this viscosity range is highly viscous, and so the ink pillar is hard to be separated from the ink meniscus M, and apt to have a curve in the droplet tail.

The driving method of this invention is strikingly effective also when the ink surface tension is 20 to 30 dynes/cm (including both). This is because the ink of this surface tension is hard to be separated from the ink meniscus M and apt to have a curve in the droplet tail.

The above embodiment assumes the pressuring device (or a partition wall) is made of a piezoelectric element. This driving method of this invention is preferable to easily control the timing of reducing the pressure of a pressure generation chamber in such a configuration.

Further, the above embodiment applies square driving waveforms to piezoelectric elements. The square wave enables easy setting of the timing to start the third step when the meniscus M reaches the recovery position and generation of a strong negative pressure.

This embodiment uses shear mode piezoelectric elements that deform by impression of electric fields as a pressurizing device. The shear mode piezoelectric elements is preferable because it can effectively use square driving waveforms of FIG. 6(*a*) at a lower driving voltage. However, this invention is not limited to the piezoelectric elements of that type. For example, the piezoelectric elements of that type can be substituted for those of the other types such as a single-plate piezoelectric actuator or an axial vibration type laminated piezoelectric element. Further, the pressurizing device can be other pressuring devices such as electromechanical converting elements that use electrostatic forces and magnetic forces and electrothermal converting elements that generates pressures by boiling.

In the above description, an ink jet print head is used as a droplet jetting head to record images. However, this invention is applicable to any head as long as it has nozzle orifices to jet droplets, pressure generating chambers which are respectively connected to the nozzle orifices, and a pressuring device to vary the pressure of each pressure generating chamber.

[Embodiments]

(Embodiment 1 to Embodiment 3)

We tested by using a shear mode print head of 180 dpi as a nozzle pitch and 15 pl as the quantity of droplet to be jetted, driving the print head by a DRR waveform having a voltage ratio of $|a|/|b|=2/1$ (Draw and Reinforce voltage ratio), jetting droplets while fixing the "on" time of the first step (Draw) to 1 AL and changing the "on" time of the second step (Reinforce), observing and calculating the ratio of $\alpha/\beta$ (where $\alpha$(μm) is the diameter (μm) of the liquid on the front end of the jetting side of the nozzle orifice and $\beta$(μm) is the maximum diameter (μm) of the ink pillar at the recovery position of the meniscus M), and inspecting the droplet tail curves of the jetted droplets.

Measurement of the ink pillar diameter: Made stroboscopic shoots of droplets that are jetted from nozzle orifices by a CCD camera and measured the diameters of ink pillars.

Inspection of droplet tail curves: Checked the droplet tail curves on the stroboscopic shoots of droplets by eyes, concerning whether the tail end before being separated from the meniscus M is parallel to the flying direction of the droplet. The result is divided into three below.

A: No curve on the tail

B: Tail curve corrected but still curved

C: Tail curved

Test ink: Oil-base ink (10 cp and 28 dynes/cm)

Driving voltage: 20 V

In every embodiment, the meniscus was not on the substantial recovery position when the ink pillar was separated.

(COMPARATIVE EXAMPLE 1)

The same as those of Embodiments 1 to 3 except $\alpha/\beta$ is ½

Table 1 shows the result of tests of Embodiments 1 to 3 and Comparative example 1.

TABLE 1

| | $\alpha/\beta$ | Meniscus | Tail curve |
|---|---|---|---|
| Comparative example 1 | 1/2 | Not on the recovery position | C |
| Embodiment 1 | 1/3 | | A |
| Embodiment 2 | 1/5 | | A |
| Embodiment 3 | 1/10 | | B |

As for Comparative example 1 in Table 1, the $\alpha/\beta$ was greater than ⅓ and the droplet tail was curved.

As for Embodiments 1 and 2, $\alpha/\beta$ was equal to or smaller than ⅓ and the droplet tails have no curves. As for Embodiment 3, the droplet tail is too thin. The tail curve was a little corrected but still existed.

Judging from the above, we found that the preferable $\alpha/\beta$ value is $$1/10<\alpha/\beta\leqq 1/3$$

(Embodiment 4 to Embodiment 7)

We evaluated jetting stabilities and fast driving abilities of these embodiments by changing the Draw-Reinforce voltage ratio ($|a|/|b|$) of the DRR square wave under conditions of Embodiment 1.

We jetted each droplet at a speed of 8 m/s and inspected the stability of each droplet by the following evaluation standard:

A: Droplets were jetted steadily.

B: Droplets were jetted almost steadily with some fluctuation in the speed but without any jetting failure.

C: Droplets were jetted but their speeds were not constant and some jetting failures occurred.

We evaluated the fast driving abilities of the embodiments by the length of the driving period.

Table 2 shows the result of the evaluations.

TABLE 2

| | Embodiment 4 | Embodiment 5 | Embodiment 6 | Embodiment 7 |
|---|---|---|---|---|
| $\alpha/\beta$ | 1/5 | | | |
| $\lvert a\rvert/\lvert b\rvert$ | 1/1 | 1.5/1 | 2/1 | 3/1 |
| Tail curve | None | None | None | None |
| Jetting stability | B | A | A | B |
| Time before $\alpha/\beta$ = 1/5 | t1 > t2 > t3 > t4 | | | |

The above embodiments all had the $\alpha/\beta$ ratio of ⅕ and their droplets had no tail curve. When the $|a|/|b|$ ratio is made greater than 1, the time before $\alpha/\beta$=⅕ becomes shorter and thus the fast driving ability is improved.

As for Embodiments 5 and 6, the remaining pressure waves were cancelled effectively and we got more stable droplet jetting.

As for Embodiments 6 and 7, the meniscus could return faster for faster driving and we got more stable droplet jetting.

Judging from the above results, we found we could get fast and stable droplet jetting when $|a|/|b|$ is 2/1 under the above driving conditions.

What is claimed is:

1. A driving method for a droplet jetting head comprising a nozzle orifice to jet a droplet, a pressure generating chamber communicating with the nozzle orifice, the pressure generating chamber can store liquid, and a pressuring device to enlarge or shrink a volume of the pressure generating chamber, the driving method comprising the steps of:

a first step for increasing the volume of the pressure generating chamber by the pressuring device;

a second step for decreasing the volume of the pressure generating chamber by the pressuring device to protrude liquid in the pressure generating chamber from the nozzle orifice after the first step; and a third step for increasing the volume of the pressure generating chamber by the pressuring device, and separating liquid protruded from the nozzle orifice by the second step as a droplet, when $\alpha/\beta$ is equal to or less than ⅓ where $\beta$(μm) is a diameter of a liquid pillar protruded from the nozzle orifice by the second step at a front end of the nozzle orifice and β(μm) is a maximum diameter of the liquid pillar;

wherein a time period during which the second step lasts is 3.5-4.4 AL, where AL is one half of an acoustic resonant period of the pressure generating chamber.

2. The driving method for a droplet jetting head of claim 1, wherein the volume of the pressure generating chamber decreased by the second step is smaller than the volume at a time before the pressure generating chamber is increased by the first step, and the volume of the pressure generating chamber increased by the third step is substantially equal to the volume at the time before the pressure generating chamber is increased by the first step.

3. The driving method for a droplet jetting head of claim 1, wherein the pressuring device is so constructed to be driven by applying a voltage to change the volume of the pressure generating chamber, and to make a pressure in the pressure generating chamber different when a different voltage is applied, and |a| is greater than |b| where "a" is a voltage applied to the pressure generating chamber in the first step and "b" is a voltage applied to the pressure generating chamber in the third step.

4. The driving method for a droplet jetting head of claim 1, wherein the pressuring device is so constructed to be driven by applying a voltage to change the volume of the pressure generating chamber and to make the pressure in the pressure generating chamber different when a different voltage is applied, and |a| is equal to 2 x |b|, where "a" is a voltage applied to the pressure generating chamber in the first step and "b" is a voltage applied to the pressure generating chamber in the third step.

5. The driving method for a droplet jetting head of claim 1, wherein the pressuring device is so constructed to be driven to change the volume of the pressure generating chamber when a voltage is applied to the pressuring device and to make a pressure in the pressure generating chamber different when a different voltage is applied, and |a|/|b| is controlled according to a time period during which the second step lasts where "a" is a voltage applied to the pressure generating chamber in the first step and "b" is a voltage applied to the pressure generating chamber in the third step.

6. The driving method for a droplet jetting head of claim 1, wherein the pressuring device includes a piezoelectric element.

7. The driving method for a droplet jetting print head of claim 1, wherein the pressuring device includes a piezoelectric element and the piezoelectric element deforms in the shear mode when an electric field is applied thereto.

8. The driving method for a droplet jetting head of claim 1, wherein a time period during which the first step lasts is 0.8-1.2 AL, where AL is one half of an acoustic resonant period of the pressure generating chamber.

9. The driving method for a droplet jetting head of claim 1, wherein a time period during which the first step lasts is 1 AL, where AL is one half of an acoustic resonant period of the pressure generating chamber.

10. The driving method for a droplet jetting head of claim 1, wherein a time period during which the second step lasts is controlled according to a viscosity of the liquid.

11. The driving method for a droplet jetting head of claim 1, wherein a time period during which the second step lasts is changed according to a transition in head temperature.

12. The driving method for a droplet jetting head of claim 1, wherein a viscosity of the liquid is equal to or more than 5 cp and equal to or less than 15 cp.

13. The driving method for a droplet jetting head of claim 1, wherein a time period during which the second step lasts is controlled according a surface tension of the liquid.

14. The driving method for a droplet jetting head of claim 1, wherein a surface tension of the liquid is in the range from 20 dyne/cm to 30 dyne/cm including both ends.

15. The driving method for a droplet jetting head of claim 1, wherein the liquid is ink.

16. The driving method for a droplet jetting head of claim 1, wherein a driving waveform to the pressuring device to change a volume of the pressure generating chamber is a rectangular wave.

17. A driving method for a droplet jetting head comprising a nozzle orifice to jet a droplet, a pressure generating chamber communicating with the nozzle orifice, the pressure generating chamber can store liquid, and a pressuring device to enlarge or shrink a volume of the pressure generating chamber, the driving method comprising the steps of:

a first step for increasing the volume of the pressure generating chamber by the pressuring device;

a second step for decreasing the volume of the pressure generating chamber by the pressuring device to protrude liquid in the pressure generating chamber from the nozzle orifice after the first step; and a third step for increasing the volume of the pressure generating chamber by the pressuring device, and separating liquid protruded from the nozzle orifice by the second step as a droplet, when α/β is equal to or less than ⅓ where α(μm) is a diameter of a liquid pillar protruded from the nozzle orifice by the second step at the front end of the nozzle orifice and β(μm) is a maximum diameter of the liquid pillar;

wherein the second pressuring device is so constructed to be driven to change the volume of the pressure generating chamber when a voltage is applied to the pressuring device and to make a pressure in the pressure generating chamber different when a different voltage is applied, and |a|/|b| is made greater as a time period during which the second step lasts becomes longer, where "a" is a voltage applied to the pressure generating chamber in the first step and "b" is a voltage applied to the pressure generating chamber in the third step.

18. The driving method for a droplet jetting head of claim 17, wherein the volume of the pressure generating chamber decreased by the second step is smaller than the volume at a time before the pressure generating chamber is increased by the first step, and the volume of the pressure generating chamber increased by the third step is substantially equal to the volume at the time before the pressure generating chamber is increased by the first step.

19. The driving method for a droplet jetting head of claim 17, wherein the pressuring device is so constructed to be driven by applying a voltage to change the volume of the pressure generating chamber, and to make a pressure in the pressure generating chamber different when a different voltage is applied, and |a| is greater than |b| where "a" is a voltage applied to the pressure generating chamber in the first step and "b" is a voltage applied to the pressure generating chamber in the third step.

20. The driving method for a droplet jetting print head of claim 17, wherein the pressuring device includes a piezoelectric element and the piezoelectric element deforms in the shear mode when an electric field is applied thereto.

21. The driving method for a droplet jetting head of claim 17, wherein a time period during which the first step lasts is 0.8-1.2 AL, where AL is one half of an acoustic resonant period of the pressure generating chamber.

22. The driving method for a droplet jetting head of claim 17, wherein a time period during which the second step lasts is made longer when a viscosity of the liquid is greater.

23. The driving method for a droplet jetting head of claim 17, wherein a time period during which the second step lasts is changed according to a transition in head temperature.

24. The driving method for a droplet jetting head of claim 17, wherein a viscosity of the liquid is equal to or more than 5 cp and equal to or less than 15 cp.

25. The driving method for a droplet jetting head of claim 17, wherein a time period during which the second step lasts is controlled according a surface tension of the liquid.

26. The driving method for a droplet jetting head of claim 17, wherein a time period during which the second step lasts is made longer when the liquid has a lower surface tension.

27. The driving method for a droplet jetting head of claim 17, wherein a surface tension of the liquid is in the range from 20 dyne/cm to 30 dyne/cm including both ends.

28. The driving method for a droplet jetting head of claim 17, wherein the liquid is ink.

29. The driving method for a droplet jetting head of claim 17, wherein a driving waveform to the pressuring device to change a volume of the pressure generating chamber is a rectangular wave.

30. A driving method for a droplet jetting head comprising a nozzle orifice to jet a droplet, a pressure generating chamber communicating with the nozzle orifice, the pressure generating chamber can store liquid, and a pressuring device to enlarge or shrink a volume of the pressure generating chamber, the driving method comprising the steps of:

a first step for increasing the volume of the pressure generating chamber by the pressuring device;

a second step for decreasing the volume of the pressure generating chamber by the pressuring device to protrude liquid in the pressure generating chamber from the nozzle orifice after the first step; and a third step for increasing the volume of the pressure generating chamber by the pressuring device, and separating liquid protruded from the nozzle orifice by the second step as a droplet, when $\alpha/\beta$ is equal to or less than ⅓ where $\alpha$(μm) is a diameter of a liquid pillar protruded from the nozzle orifice by the second step at the front end of the nozzle orifice and $\beta$(μm) is a maximum diameter of the liquid pillar;

wherein a time period during which the second step lasts is made longer when a viscosity of the liquid is greater.

31. The driving method for a droplet jetting head of claim 30, wherein a viscosity of the liquid is equal to or more than 5 cp and equal to or less than 15 cp.

32. The driving method for a droplet jetting head of claim 30, wherein a time period during which the second step lasts is made longer when the liquid has a lower surface tension.

33. A driving method for a droplet jetting head comprising a nozzle orifice to jet a droplet, a pressure generating chamber communicating with the nozzle orifice, the pressure generating chamber can store liquid, and a pressuring device to enlarge or shrink a volume of the pressure generating chamber, the driving method comprising the steps of:

a first step for increasing the volume of the pressure generating chamber by the pressuring device;

a second step for decreasing the volume of the pressure generating chamber by the pressuring device to protrude liquid in the pressure generating chamber from the nozzle orifice after the first step; and a third step for increasing the volume of the pressure generating chamber by the pressuring device, and separating liquid protruded from the nozzle orifice by the second step as a droplet, when $\alpha/\beta$ is equal to or less than ⅓ where $\alpha$(μm) is a diameter of a liquid pillar protruded from the nozzle orifice by the second step at the front end of the nozzle orifice and $\beta$(μm) is a maximum diameter of the liquid pillar;

wherein a time period during which the second step lasts is made longer when the liquid has a lower surface tension.

* * * * *